US006364365B1

(12) United States Patent
Caplan

(10) Patent No.: US 6,364,365 B1
(45) Date of Patent: Apr. 2, 2002

(54) PERSONAL LUGGAGE IDENTIFICATION SYSTEM AND METHODS FOR USE

(76) Inventor: Frances J. Caplan, 7184 Woodrow Wilson Dr., Los Angeles, CA (US) 90068

( * ) Notice: Subject to any disclaimer, the term of this patent is extended or adjusted under 35 U.S.C. 154(b) by 0 days.

(21) Appl. No.: 09/571,453

(22) Filed: May 16, 2000

Related U.S. Application Data

(60) Provisional application No. 60/134,878, filed on May 19, 1999.

(51) Int. Cl.[7] ..... B42D 15/00
(52) U.S. Cl. ..... 283/80; 40/299; 283/75
(58) Field of Search ..... 283/74, 75, 77, 283/78, 79, 80, 81; 40/299

(56) References Cited

U.S. PATENT DOCUMENTS 4,065,343 A 12/1977 Stumpe
4,180,284 A * 12/1979 Ashley ..... 283/80 X
4,634,849 A 1/1987 Klingen
5,058,959 A 10/1991 Miles et al.
5,145,211 A * 9/1992 McKillip ..... 283/80
5,295,695 A 3/1994 Tamanini
5,560,657 A * 10/1996 Morgan ..... 283/80
5,839,215 A 11/1998 Lasprogata
5,900,307 A * 5/1999 Barcikowski ..... 283/80 X

OTHER PUBLICATIONS

Search Report dated Mar. 07, 2001.

* cited by examiner

*Primary Examiner*—Willmon Fridie, Jr.
(74) *Attorney, Agent, or Firm*—Oppenheimer Wolff & Donnelly LLP

(57) ABSTRACT

A new adaptable luggage identification system and methods for its use is disclosed. The system includes luggage recognition devices including adhesive stickers, tape, firm plastic tags, flexible plastic labels, business card carriers, tags, envelopes and cards, each bearing its own distinctive pattern, which can be affixed to luggage either singularly or in combination to provide a distinctive pattern or combination of patterns. The luggage recognition devices can be used to aid in the rapid identification of individual pieces of luggage, groups of luggage, contents of luggage or any combination thereof.

2 Claims, 6 Drawing Sheets

PERSONAL LUGGAGE IDENTIFICATION SYSTEM AND METHODS FOR USE

This application claims benefit to U.S. provisional application Ser. No. 60/134,878, filed May 19, 1999.

FIELD OF THE INVENTION

A personal luggage identification system consisting of luggage recognition devices with distinctive patterns integrated therein and methods for use.

BACKGROUND OF THE INVENTION

Domestic and international travel continues to increase annually. Each year billions of dollars are spent by passenger carriers to sort, track and process passengers' bags. Yet, this is only part of the battle. Once the luggage arrives safely at its intended destination—be it an airport, bus station, train depot, or cruise ship terminal—the passenger must be able to quickly identify his or her own luggage from the myriad look-alike suitcases and trunks which are being simultaneously processed.

In the midst of the confusion experienced by frantic and exhausted passengers all seeking to collect their possessions promptly and to leave the luggage depot, mistakes happen. Misidentified parcels are often innocently taken away before its rightful owner realizes what has happened. Furthermore, crowded airports, bus stations, and train depots are ideal places for less scrupulous individuals to misappropriate fatigued travelers' luggage.

The luggage industry has been successful in refining their products to resist damage, protect travelers' possessions, meet carriers' guidelines as to shape and size, and to standardize the manufacturing processes. Consumers seek a durable product that resists the unavoidably rough handling experienced during travel, and one that does not show the marks and dirt inevitably associated with cargo holds, transport devices and the hands of luggage personnel. Consequently, most luggage, regardless of the manufacturer, are remarkably similar in shape, size and color, and are often only differentiated by subtle logos and design features not easily recognized at a distance, or even in close proximity.

In many cases, luggage may only be identified by a small textual I.D. tag attached by an elastic, plastic or leather strap. These tags are difficult to read quickly and can easily be lost during handling. This is especially true as more and more carriers begin using sophisticated optical scanning systems that require the luggage to be rotated about its axis thus exposing it to moving parts repetitively. Such automated sorting systems are particularly prone to literally tearing traditional identification tags from luggage.

One method for identifying luggage that does not rely on traditional tags is disclosed in U.S. Pat. No. 5,058,959. In the '959 patent, adhesive labels are affixed to the wheel assembly of luggage so equipped. This provides a method for placing an identifying marker on an area of the luggage not likely to be damaged in use. However, it is of limited usefulness in identifing luggage in busy airports, bus stations, or train depots. When an identification label is restricted to the wheel, it requires that the luggage be in a specific position to present the adhesive label to the owner before it can be identified. Thus, if the luggage's wheel assembly is buried beneath other items (which is often the case due to the fact that the wheeled end is more heavily weighted and easily entangled with other articles) the identification labels are not visible. Furthermore, if the luggage is either intentionally or otherwise misappropriated, the identification label of the '959 patent is well below the line of sight requiring an observer to stare down at or near the floor to identify the missing luggage.

Another disadvantage of the identification system disclosed in the '959 patent is that it limited utility. Wheeled luggage still makes up only a minority of luggage used. Furthermore, the '959 patent requires that the wheels be relatively large and exposed on the luggage's exterior. Moreover, a growing majority of luggage manufacturers have integrated the wheel assembly into the luggage's chassis thus making it impossible to affix a label to the wheel.

Other luggage identification systems described in U.S. Pat. Nos. 4,065,343, 4,180,284 and 4,634,849 are intended for use by air carriers rather than luggage owners and rely on a plain black and white identifying label which requires close scrutiny by the luggage owner. These, identification systems assist luggage handlers in identifying, tracking, and routing passenger luggage using both manual and automated systems, but does not ease the burden on the weary traveler.

U.S. Pat. No. 5,295,695 discloses a method of coding children gifts using a set of stickers all with identical patterns. The child then uses a clue card bearing the same patterns to identify their property. While this identification system may be useful with children's games and gift exchanges, it fails as a luggage identification system because there is nothing in the '695 patent that discloses or suggests its utility for identifying luggage in the high intensity environment of a luggage depot.

Therefore, there exists a need to identify luggage from similar pieces encountered when traveling.

Accordingly, it is an object of the present invention to provide a adaptable luggage identification system that addresses these needs.

It is another objective of the present invention to provide a luggage identification system that will deter theft and prevent accidental misappropriation by making individual luggage pieces easily distinguishable from all others and readily recognized in crowded environments.

It is yet another objective of the present invention to provide a luggage identification system that can be used on all types of luggage in all environments.

An additional object of the present invention is to provide methods for systematically identifying luggage that permits groups of people to distinguish their luggage from that of all other travelers' luggage and simultaneously identify each group member's individual luggage and/or contents therein.

It is another object of the present invention to provide a luggage identification system that assists visually impaired persons in locating and tracking luggage or other objects to which the identification system of the present invention are affixed.

SUMMARY OF THE INVENTION

These and other objects are achieved by the present invention which provides a luggage identification system and methods for its use. The luggage identification system consists of a series of highly visible, labels, stickers, tape rolls and folders each having at least one distinctive pattern integrated therein comprising luggage recognition devices; the distinctive patterns can include color options. These luggage recognition devices assist the traveler in identifying his luggage, or other article to which it is affixed. These distinctive luggage recognition devices can be used separately, or in any combination, which allows the user to create a distinctive identification system to better differentiate her luggage from others. The luggage owner may also use additional luggage recognition devices to specifically identify the contents of each piece of luggage. When used in this manner the luggage identification system of the present invention permits the user to determine the content of each piece without opening it.

Thus the system of the present invention does not require the user to read a label, nor does it demand close scrutiny. Consequently, the user can quickly, and precisely identify his luggage and track it in crowded and busy environments. Moreover, the highly visible labels, stickers, tape rolls and folders of the present invention are particularly valuable to people who are visually impaired. The highly visible unique identification systems of the present invention can be readily seen and identified over great distances in addition to providing easily identified markers at close range under poor visibility circumstances.

One or more luggage recognition devices of the present invention can be affixed either temporarily or permanently to any luggage type.

These and other aspects of the present invention are set forth in the following detailed description and claims, particularly when considered in conjunction with the accompanying drawings.

DETAILED DESCRIPTION OF THE INVENTION

Figure 1:
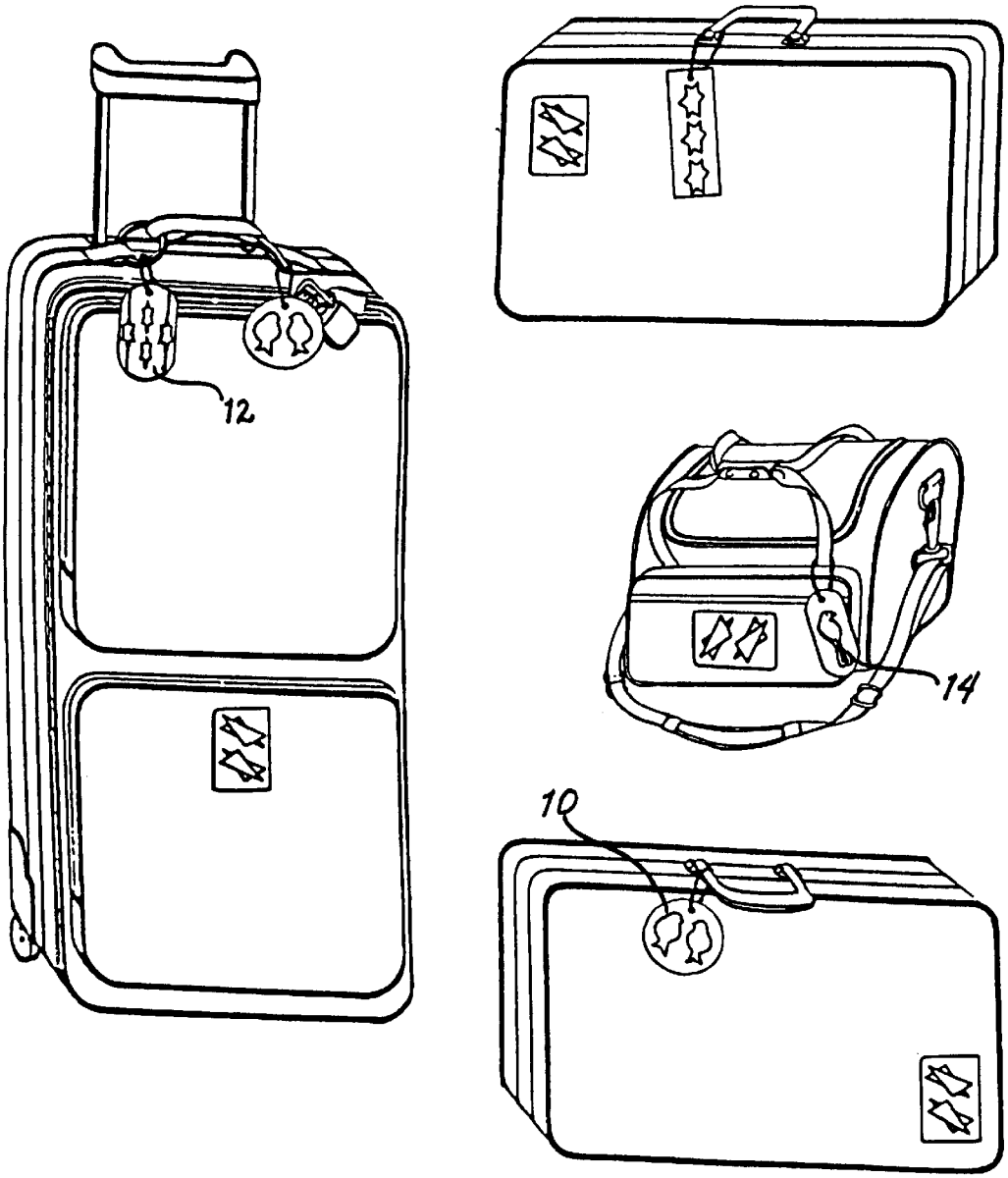
FIG. 1 depicts a first embodiment of the luggage identification system of the present invention.
Figure 2:
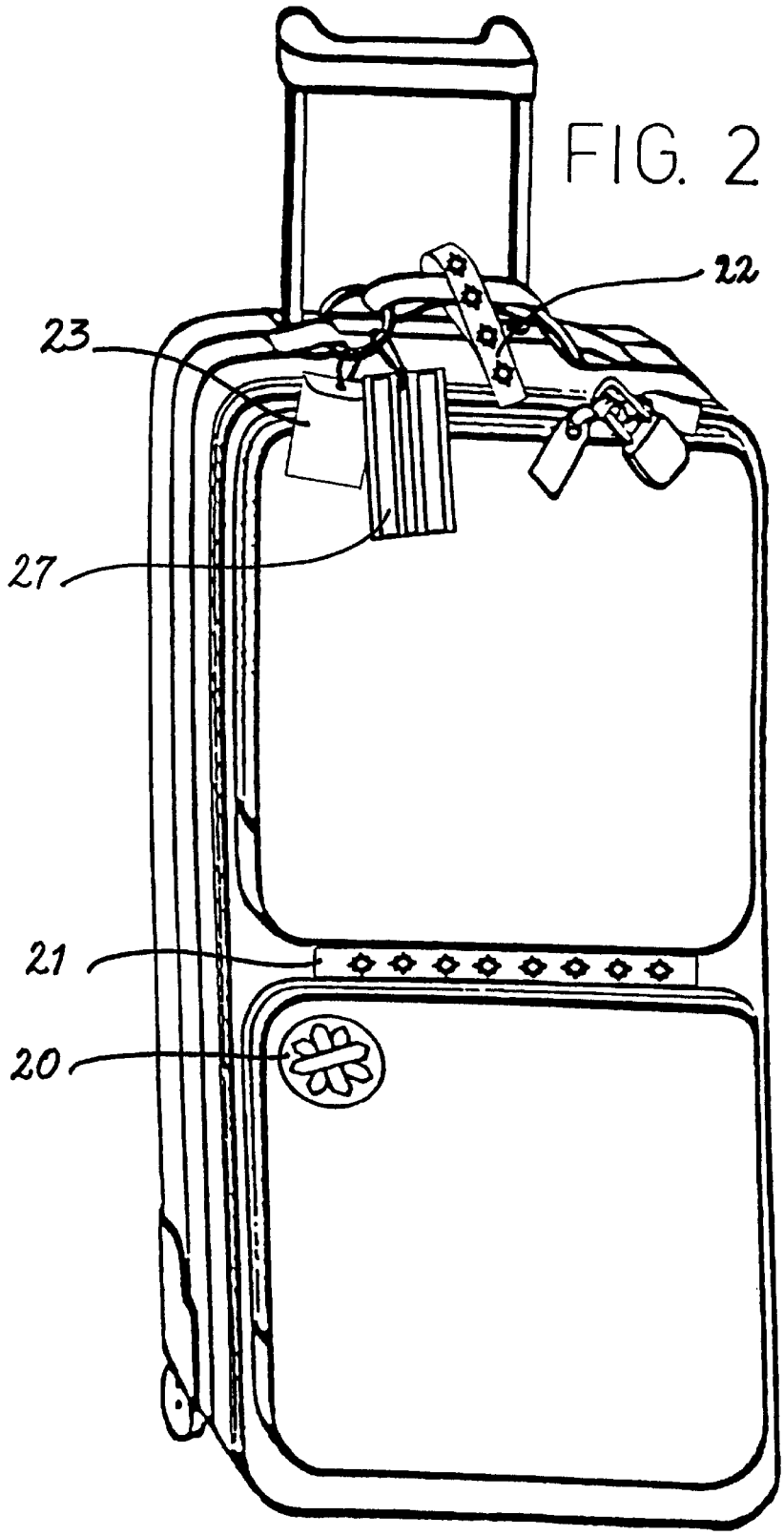
FIG. 2 depicts a second embodiment of the present invention.

The present invention provides a highly visible and adaptable luggage identification system that can be used on any type, shape or style of luggage, non-limiting examples of which are depicted in FIG. 1. The luggage identification system of the present invention as depicted in FIGS. 1 and 2 consists of luggage recognition devices including, but not limited to, adhesive stickers 20, tape 21, firm plastic tags 10, flexible plastic labels 22, business card carriers 12, tags 14, envelopes 23 and cards 27 that bear distinctive patterns in various assorted colors, shades, and tones. These distinctive patterns are visually unique from one another at a relatively large distance and range in color from subtle pastels to intense fluorescent colors including orange, green, blue, red, yellow and shades in between. Each combination of distinctive patterns and colors can be integrated into the luggage recognition devices. The luggage recognition devices of the present invention can be affixed to luggage in conspicuous locations using straps, string, tape, adhesives or any similar techniques or any combination thereof.

The distinctive patterns and colors associated with the luggage identification systems of the present invention also provide methods and devices for use by the visually impaired. The crowded, confusing and often poorly lighted environments associated with travel present a particularly challenging situation for persons with reduced visual acuity. Consequently, any recognition device that could permit rapid positive identification of luggage, or other personal articles, would significantly improve the life quality of the visually impaired. Placing highly recognizable stickers, tags labels and cards of the present invention in various locations on personal articles (personal recognition devices) including, but not limited to, luggage, will make any such article easier to identify for persons with most forms of vision deficiencies.

Figure 3:
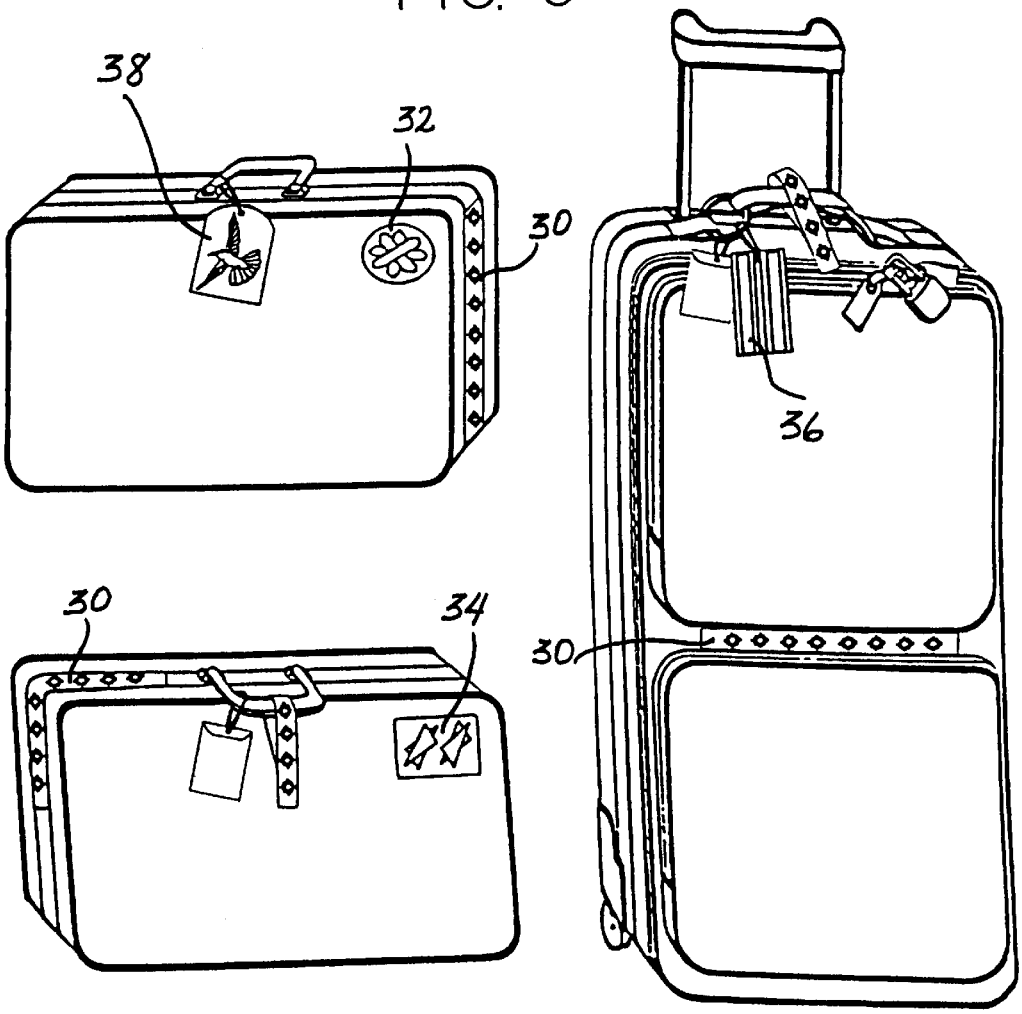
FIG. 3 depicts using the luggage identification system to identify groups of travelers while simultaneously providing immediate recognition of luggage belonging to an individual member of the group.
Figure 4:
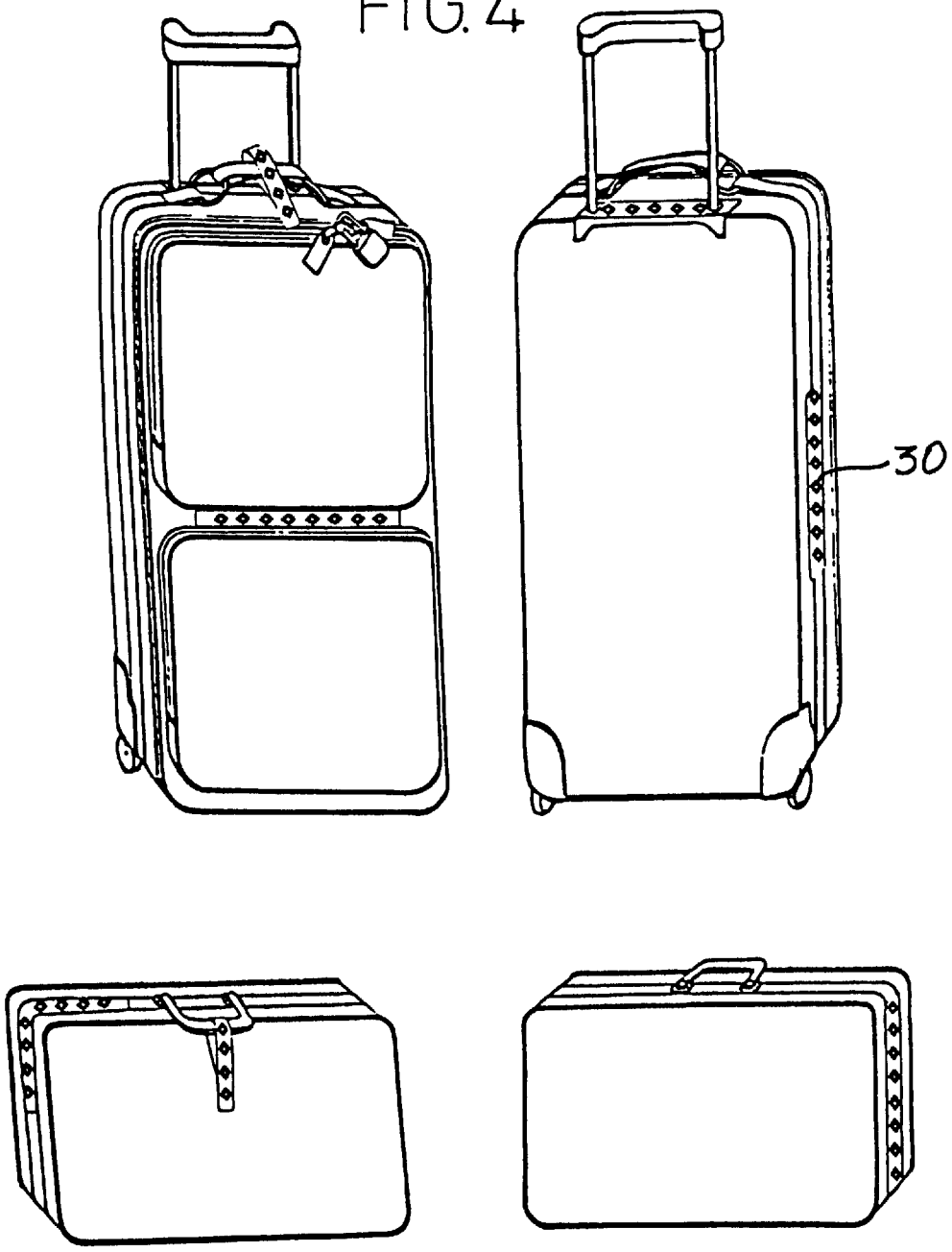
FIG. 4 depicts using the luggage identification system of the present invention to identify group member's luggage.

The luggage identification system and luggage recognition devices of the present invention are ideally suited to be used in combination to provide the user with immediate identification of her luggage and its contents. Furthermore, when traveling with a group, the system as depicted in FIG. 3 can be used to identify members of the group 30, individuals within the group 32,34,36, and contents of a particular luggage 38. For example, a group of travelers may select a luggage recognition device as in FIG. 4 with a distinctive pattern 30 to identify the group. Each member of the group then selects a luggage recognition device with a different distinctive pattern and color to identify his or her personal luggage 32,34,36. To further sort the luggage, individual group members may choose to identify luggage containing sundry items using a luggage recognition device 38 with yet a different pattern attached to it, while luggage containing clothing can have a separate distinct luggage recognition device attached, and so on. A nearly infinite number of distinctive combinations are envisioned using the luggage identification system and luggage recognition devices of the present invention. While these exemplary embodiments are intended to demonstrate the present invention's adaptability, it is understood that any number of combinations can be used to differentiate potential luggage subsets.

In one embodiment of the present invention the identification system consists of flexible laminated clear plastic cards with distinctive patterns in assorted colors integrated therein. By way of example only, and not intended as a limitation, the distinctive patterns include a bird in flight, a pair of love birds, stars, rings, dots, etc. each highly colored to maximize contrast with the surrounding luggage and to increase recognition.

In another embodiment of the present invention, rolls of clear adhesive tape are printed with these distinctive patterns. The tape is then affixed to the luggage either alone or in combination with other embodiments of the present invention. The tape is also ideally suited to secure shipping containers closed, or reinforce boxes, bags and luggage while providing the item with a distinct identification system as disclosed herein.

In yet another embodiment of the present invention self adhesive, "peel back," stickers are printed with these distinctive patterns and affixed to luggage in visible locations to assure rapid identification from any angle regardless in what position the luggage is situated.

These distinctive patterns and colors may also be incorporated into business card carriers that are then affixed to the luggage by a strap or other method. The business card carriers can contain specific information required by air carriers and shippers while simultaneously participating in the overall luggage identification system of the present invention by presenting the highly visible distinctive patterns selected by the user.

Figure 5:
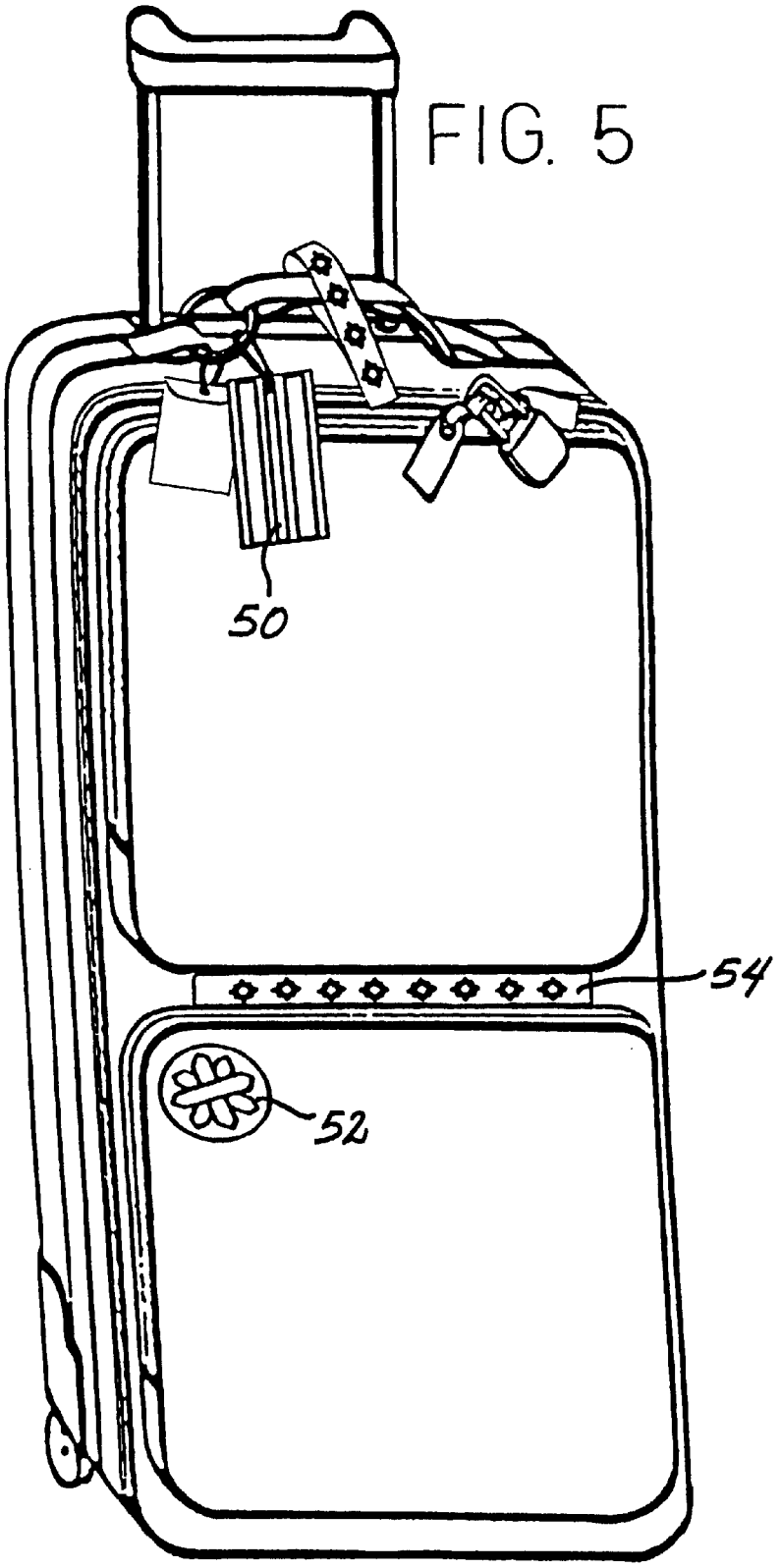
FIG. 5 depicts further distinguishing one's luggage by using multiple luggage recognition devices of the present invention.

In another embodiment of the present invention FIG. 5 depicts the luggage recognition devices can be used simultaneously in additional patterns selected by the individual traveler, thus significantly reducing any possibility of coincidental mis-identification of luggage. The luggage recognition devices of the present invention can be affixed to luggage in a variety of different combinations. For example, in FIG. 5 the traveler may wish to place at least one flexible tag 50 on the luggage in addition to at least one self-adhesive sticker 52, and at least one strip of tape 54 all bearing the same, or different, distinctive patterns in the same or different colors. This may be done to further differentiate his luggage from others, to make his luggage more easily identified, to assure that at least one identifier remains affixed, or any combination of the three.

Figure 6:
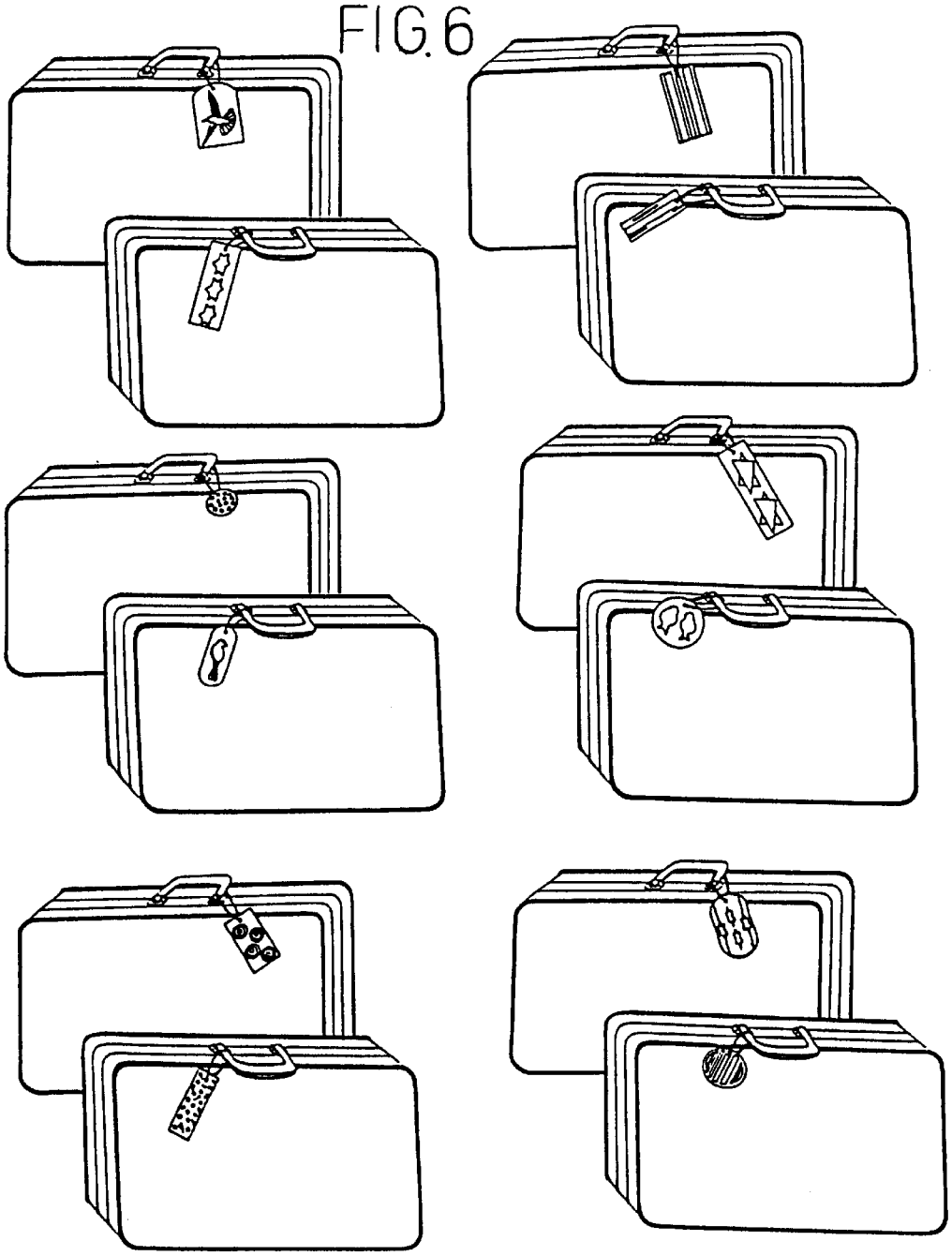
FIG. 6 depicts the ease with which similar luggage can be identified in accordance with the teachings of the present invention.

The present invention provides a rapid, visually distinctive means of easily distinguishing between articles of nearly identical luggage as shown in FIG. 6.

While this invention has been described with respect to various specific drawings and embodiments, it is to be understood that the invention is not limited thereto and that it can be variously practiced within the scope of the following claims.

I claim:

1. A non-alphanumeric luggage identification system comprising:

a first luggage recognition device, wherein said first luggage recognition device has a distinctive shape and a distinctive pattern integrated therein;

said first recognition device conspicuously attached to at least one surface of at least two articles of luggage, wherein said first recognition device identifies a common group of luggage;

at least one second luggage recognition device, wherein said at least one second luggage recognition device has a distinctive shape and a distinctive pattern integrated therein; and said at least one second recognition device conspicuously attached to at least one surface of at least one article of luggage, wherein said second recognition device identifies a piece of luggage belonging to said common group of luggage.

2. The non-alphanumeric luggage identification system according to claim 1 further comprising:

a third luggage recognition device, wherein said third luggage recognition device has a distinctive shape and a distinctive pattern integrated therein; and said third recognition device conspicuously attached to at least one surface of at least one article of luggage, wherein said third recognition device identifies the contents of said piece of luggage belonging to said common group of luggage.

* * * * *